US006929555B2

(12) United States Patent
Morton

(10) Patent No.: US 6,929,555 B2
(45) Date of Patent: Aug. 16, 2005

(54) CUE STICK BRIDGE SUPPORT

(76) Inventor: D. Herbert Morton, 1375 Pershing Blvd., Unit 508, Reading, PA (US) 19607

( * ) Notice: Subject to any disclaimer, the term of this patent is extended or adjusted under 35 U.S.C. 154(b) by 83 days.

(21) Appl. No.: 10/141,073

(22) Filed: May 9, 2002

(65) Prior Publication Data

US 2003/0211897 A1 Nov. 13, 2003

(51) Int. Cl.[7] ..... A63D 15/10; A63D 15/00
(52) U.S. Cl. ..... 473/42; 473/43
(58) Field of Search ..... 473/1, 2, 5, 42, 473/43, FOR 1; 42/94

(56) References Cited

U.S. PATENT DOCUMENTS

| | | | | | |
|---|---|---|---|---|---|
| 62,827 | A | * | 3/1867 | Dolan | 473/42 |
| 213,209 | A | * | 3/1879 | Knight | 273/127 R |
| 774,862 | A | * | 11/1904 | Blackburn | 473/42 |
| 879,052 | A | * | 2/1908 | Jeranek | 89/40.06 |
| 890,789 | A | * | 6/1908 | Nelson | 473/42 |
| 898,345 | A | * | 9/1908 | Farnham | 473/42 |
| 968,187 | A | * | 8/1910 | McIntire | 473/42 |
| 1,227,312 | A | * | 5/1917 | Rear | 473/42 |
| 1,441,285 | A | * | 1/1923 | Johnston et al. | 42/94 |
| 2,014,788 | A | * | 9/1935 | Strickler et al. | 473/42 |
| 2,420,267 | A | * | 5/1947 | Sefried | 42/94 |
| 2,436,349 | A | * | 2/1948 | Adams | 42/94 |
| 2,472,804 | A | * | 6/1949 | Bird | 89/37.01 |
| 2,489,283 | A | * | 11/1949 | Garand | 42/94 |
| 2,569,435 | A | * | 9/1951 | Martin | 42/94 |
| 2,807,904 | A | * | 10/1957 | Kreske | 42/94 |
| 2,817,525 | A | * | 12/1957 | Niemann | 473/42 |
| 3,106,802 | A | * | 10/1963 | Gallo | 47/55 |
| 3,327,422 | A | * | 6/1967 | Harris | 42/94 |
| 4,149,718 | A | * | 4/1979 | Russo | 473/42 |
| 4,907,799 | A | * | 3/1990 | Danner et al. | 473/42 |
| D346,636 | S | * | 5/1994 | Bechtel | D22/108 |
| D356,137 | S | * | 3/1995 | Hull et al. | D22/108 |
| 5,853,333 | A | * | 12/1998 | Patterson | 473/42 |
| 6,419,588 | B1 | * | 7/2002 | Watlack et al. | 473/42 |

FOREIGN PATENT DOCUMENTS

| | | | | |
|---|---|---|---|---|
| FR | 2680978 | * | 5/1991 | |
| GB | 2196867 | A | * 11/1986 | |
| GB | 2200562 | A | * 8/1988 | A63D/15/10 |
| GB | 2235880 | A | * 9/1989 | |
| GB | 2323300 | A | * 9/1998 | A63D/15/10 |
| GB | 2329845 | A | * 4/1999 | A63D/15/10 |
| GB | 2366212 | A | * 3/2002 | A63D/15/10 |

* cited by examiner

*Primary Examiner*—Mitra Aryanpour
(74) *Attorney, Agent, or Firm*—Antonelli, Terry, Stout & Kraus, LLP

(57) ABSTRACT

Apparatus for holding and supporting a cue bridge stick while playing a game such as pool and billiards. The top of a body member holds the bridge handle, while the bottom of the body member connects to legs for supporting the body member from a flat surface such as the playing surface of a pool table. The legs extend downwardly from the body member a desired distance to rest upon the playing surface.

8 Claims, 4 Drawing Sheets

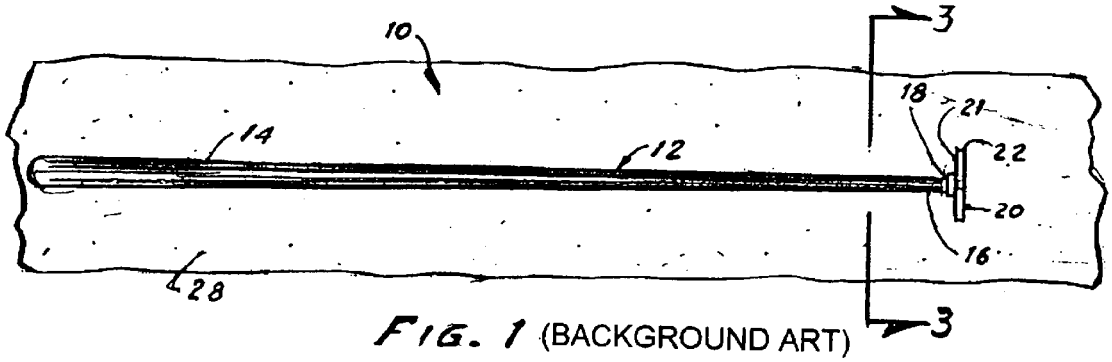
FIG. 1 (BACKGROUND ART)
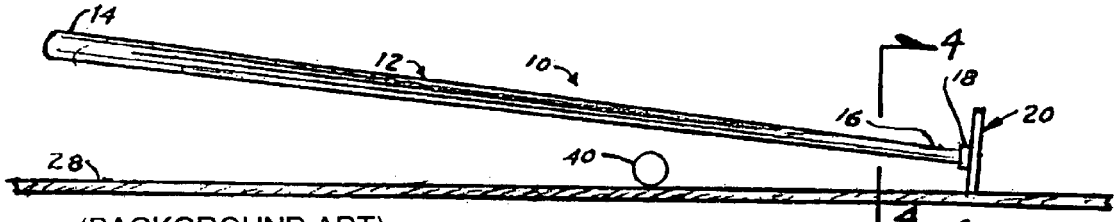
(BACKGROUND ART) FIG. 2
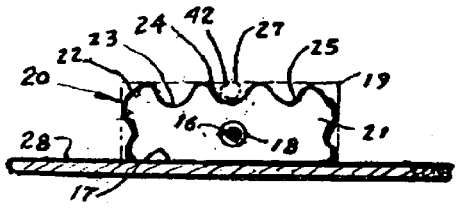
FIG. 3
(BACKGROUND ART)
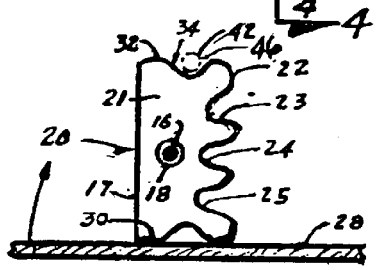
FIG. 4
(BACKGROUND ART)
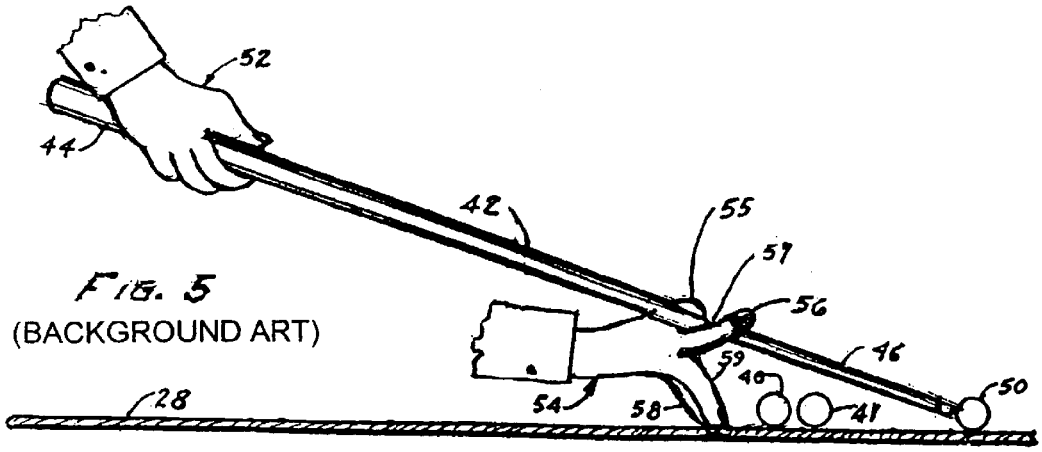
FIG. 5
(BACKGROUND ART)

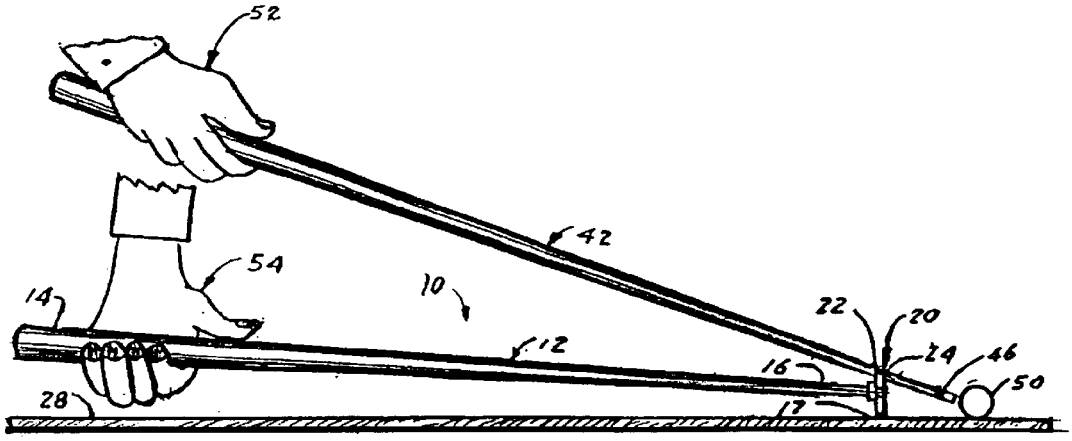
FIG. 6
(BACKGROUND ART)
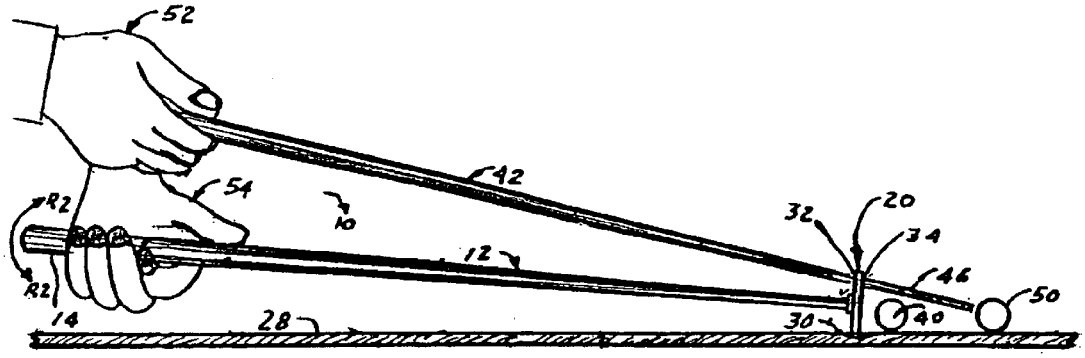
FIG. 7
(BACKGROUND ART)
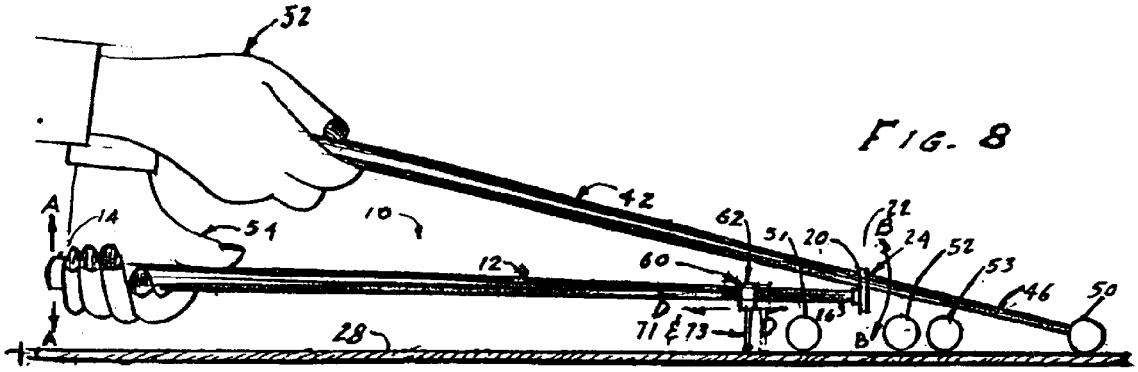

CUE STICK BRIDGE SUPPORT

TECHNICAL FIELD

This invention related to an apparatus for supporting, in combination with a prior art device referred to as a "bridge", a cue stick for striking and propelling a driving ball (sometimes called a "cue ball") over a flat surface. More particularly, games such as pool and billiards require that a ball be driven along a precise path over a flat surface. A driving ball may be inconveniently located close to other balls or beyond easy reach of a player, and therefore be difficult to strike with precision. This invention relates to an apparatus to facilitate striking such inconveniently located driving balls.

BACKGROUND OF THE INVENTION

Games of pool or billiards have endured over the years since their respective invention and now involve large rosters of professional players, large audiences and large sums of money. The apparatus for playing these games are being upgraded by highly skilled and inventive artisans who are inspired by a love of the game and by the large sums of money available to improve and facilitate play of the games. Such apparatus includes, but is not limited to, at least one driving, or cue ball which is usually white in color, a plurality of variously colored balls, sometimes called "object balls," which are to be propelled in desired directions by the cue ball, and one or more cue sticks utilized for striking a cue ball. A cue stick may typically be about five feet long and made of wood such as ash or maple and be circumferentially tapered from about 14 mm diameter at a free, gripping end to about 11 mm diameter at an opposite, free striking end. Advantageously, there is assembled to the cue stick at the striking end, a deformable tip so the cue ball may be pressed into the tip by force of the cue stick when it is longitudinally translated and the Up is driven against the cue ball. The pressing of a deformable tip to a cue ball facilitates giving "spin" to a cue ball, sometimes called giving English to the ball. Another purpose of the tip is to impart velocity to the cue ball; still another purpose is to impart precise aim to the cue ball. It will be appreciated that imparting and controlling such spinning, velocity and aim cannot be achieved unless the cue stick is properly supported so its tip engages the cue ball exactly as desired by a player. Normally, such support is achieved by a player applying a first hand near the gripping end of the cue stick for supportively translating the cue stick and applying a second hand near the striking end for supporting and guiding the tip of the cue stick into the desired engagement with the cue ball. Such guiding is typically achieved by placing the second hand downwardly upon the flat driving surface of the table, then raising the knuckles and thumb upwardly to form a "V" shaped bridge between the thumb and adjacent knuckle for supportively guiding the cue stick. Also, a player may utilize the forefinger of the guiding hand to wrap around and guide the cue stick. If the cue ball is close to a side rail which supportively encompasses the table, such rail may be utilized by the guiding hand to supportively guide the cue stick.

A problem is that the cue ball may not always be conveniently located whereby supportively translating and guiding the cue stick may be achieved utilizing only a player's first and second hands. For example, the cue ball may be located closely adjacent to one or more object balls. Also, the cue ball may be located so far away from a side rail of the table that a player cannot extend his or her second hand sufficiently to get close enough to the cue ball to supportively guide the cue stick and tip into the desired engagement with the cue ball.

The problem of inconveniently located cue balls was addressed in the prior art primarily with apparatus referred to as a "bridge" (sometimes called a "rake" because the bridge sometimes resembles a miniature garden rake). The bridge has a handle resembling a cue stick with a gripping free end and a guiding end. Across the guiding end there is provided a rectangular guide plate. The guide plate has a longer side which may be 4" to 6" long and a shorter side which is about 2"–2½" long. An edge of the longer side and an edge of the shorter side have "V" shaped notches. In use the player places one long side of the guide plate on the flat playing surface, utilizing the bridge handle to position the guide plate on the player's side of the cue ball. Then the cue stick has its handle, adjacent the guiding free end, placed into a notch along the upper edge of the bridge. By manipulating the gripping end of the cue stick with the player's one hand and manipulating the gripping end of the bridge handle with the player's other hand, the tip of the cue stick is brought into a desired position for engagement with the cue ball. When the cue ball is obstructed, such as by one or more object balls, the player rotates the bridge handle to bring one of the short sides of the rectangular guide plate to rest on the flat playing surface, elevating the notch on the other short side of the bridge guide plate. The cue stick handle, adjacent the guiding end of the cue stick, is then placed in the elevated notch, whereby the cue Up may be translated over the obstruction and into a position for the desired engagement with the cue ball.

A problem with prior art bridges is that the guide plate often provides unstable support of the cue stick. Such instability is especially evident when the guide plate is rotated to rest on its short end to elevate the guiding end of the cue stick. Sometimes the guide plate cannot be placed sufficiently close to the cue ball, and so the cue stick, slidably supported in a notch in the guide plate, cannot be properly translated over obstructions and into the desired engagement of a cue ball.

Accordingly, it is desirable to provide new and improved apparatus for supporting portions of a bridge and a cue stick. It is desirable to bring the guiding end of the cue stick and its tip into a desired engagement with the cue ball when the cue ball is inconveniently distant from a player or is obstructed, such as by object balls. Prior art bridges are found with most pool and billiard apparatus, so it is desirable to provide apparatus to enhance guiding support provided by such bridges. It is further desirable that such apparatus be easily carried in a player's pocket and be readily applied to such known bridges.

SUMMARY OF THE INVENTION

Apparatus is provided for supporting a load such as a portion of a bridge and a cue stick utilized in playing games such as pool and billiards. A bridge support has a body with bottom legs and a top trough which is upwardly concaved and of a size and shape to fit closely and at least slightly more than halfway around the circumference of the handle of a bridge. The trough is sufficiently long so the length and fit of the trough provide the desired support for the bridge. A portion of the cue stick is supported by the bridge, and, therefore, portions of the bridge and the cue stick are supported by the bridge support of the invention. The trough of the body also has opposing sidewalls extending the length of each side of the trough and of a height above that of the bridge handle when placed in the trough sufficient that each sidewall has portions above the handle which may curve away from the opposing portion to readily accept and guide the bridge handle into the trough.

In a presently preferred embodiment, the body and its sidewalls are made of resiliently pliable material, and the sidewalls are biased toward one another such that the sidewalls are forced apart to accept the bridge handle in the trough with a snap-fit. Such material of the body and the snap-fit are sufficiently strong that the bridge support may remain firmly snapped onto the handle when the bridge is lifted and carried about by a player.

The opposing sidewalls of the body may extend downwardly from the trough to form on either side of the body respective opposing skirts for connection to respective opposing support legs. A top portion of each leg may be flattened into a plate extending upwardly along a surface of a respective skirt inwardly of the body. A thru-bore in each skirt and a thru-bore in each plate may be provided, and a respective skirt and the plate of a respective leg may be assembled in matching relation by a thru bolt and nut installed and tightened in matching thru-bores for connecting each leg to a skirt.

The opposing skirts of the body form an inverted "V" shape, whereby the legs when connected to such skirts extend downwardly to continue and enhance the inverted "V" shape. Such legs are sufficiently long to support the body with a bridge handle therein so the bridge guide plate will support and aim the guiding end of a cue stick in a manner and at sufficient height to engage a cue ball as desired.

In a further embodiment, at the bottom end of each leg, a rounded smooth portion is provided so the bridge support may be slid over a playing surface without damage to said surface.

In another embodiment, the legs are pivotally connected to the skirts of the body. Resilient inserts are employed in nuts for bolts for biasing a leg plate against its respective skirt such that, when a leg is pivoted about a bolt said bolt and its connecting nut remain in tight connection. The plate at the top of each leg plate may have a cam configuration around its bolt connection. A portion of the cam is wider than the remaining portions, and such wider portion bears on a portion of the body to prevent pivoting of the leg in a first circular direction and to permit pivoting of the leg in a second circular direction. When both legs are pivoted in the desired second circular direction, the legs may be stored in a preferred manner substantially parallel to the bridge handle. When the body is snapfitted to such bridge handle and the legs are properly pivoted for storage, the bridge support is readily carried by a player along with the bridge.

BRIEF DESCRIPTION OF THE DRAWINGS

The invention will be more readily understood from the following detailed description when read in conjunction with the drawing wherein:

FIG. 1 is a plan view of a Prior Art bridge utilized to support and guide a cue stick.

FIG. 2 is a side elevation view of the Prior Art bridge shown in FIG. 1.

FIG. 3 is a front view of a substantially rectangular guide plate taken along line 3—3 in FIG. 1.

FIG. 4 is a rear view of the guide plate taken along line 4—4 in FIG. 2 but showing the guide plate rotated.

FIG. 5 is a pictorial view of an unseen player manipulating one hand upwardly to elevate and guide a cue stick gripped by his other hand using the Prior Art to engage a cue ball.

FIG. 6 is a view similar to that of FIG. 5, wherein a Prior Art bridge is utilized in a typical manner to support and guide a cue stick to engage a cue ball which is too distant for the player to engage utilizing only his hands.

FIG. 7 is a view similar to that of FIG. 5, wherein the bridge handle is rotated to turn the guide plate upwardly extending its full length for the player to bridge over an obstructing object ball to engage a cue ball using the Prior Art.

FIG. 8 is a view similar to FIG. 6 and FIG. 7, wherein a typically oriented bridge is elevated by a bridge support in accordance with the present invention such that the guide plate is utilized in an elevated manner so the cue stick may be bridged well over obstructions for engaging the cue ball.

Figure 9:
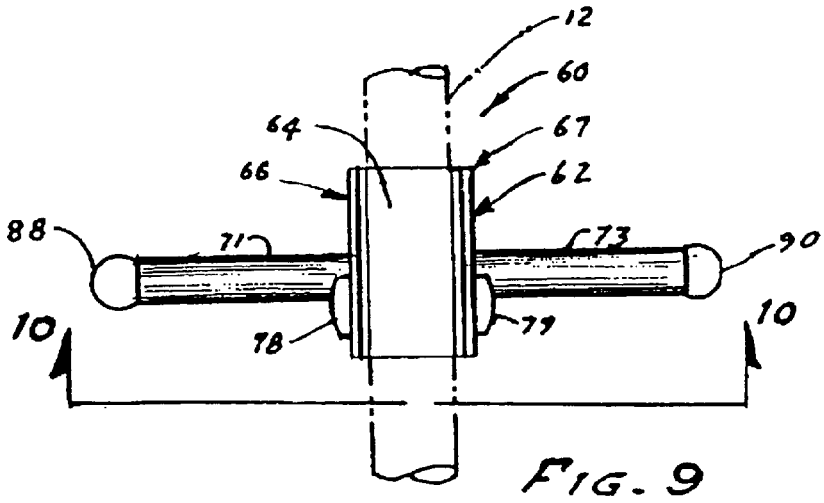
FIG. 9 is a top view of a bridge support according to one embodiment of the instant invention.

It can be seen that some features in the figures are abbreviated or simplified to highlight certain aspects of the invention. Also, where appropriate, reference numerals have been repeated in the figures to designate the same or corresponding features.

DETAILED DESCRIPTION

It is well know among pool and billiards players that a slight error in engaging and striking a cue ball can make a serious difference in the path and spin of the ball and the results of the play. Much skill is required when a cue ball is inconveniently located, such as by being distant from the reach of a player's arms or by being closely obstructed such as by object balls. One approach to engaging such cue balls is to employ a mechanical extension to a player's reach utilizing a device such as a bridge 10 shown in FIG. 1. The bridge 10 includes a handle 12 having a free gripping end 14 and tapering to a thinner, opposite end 16, very much like a conventional cue stick shown in FIG. 5. A difference is that the handle 12 has no cue tip, but instead is fixedly assembled to a hub 18 of a substantially rectangular guide plate 20 disposed across the free end 16 of the bridge handle 12.

FIG. 3 is a front view of guide plate 20 taken along line 3—3 in FIG. 1. A phantom outline 19 is drawn about guide plate 20 in FIG. 3 to indicate the substantially rectangular configuration of plate 20, which may be 4" to 6" long and may be 2" to 2½" wide. Plate 20 has a face 21 containing the hub 18, and there is a long bearing edge 17 and another long opposite edge 22 containing notches 23, 24 and 25. The end 16 of bridge handle 12 is seen in section in FIG. 3, and it is fixedly attached by means (not shown) to hub 18. Also, for clarity, a phantom lined picture of an end 27 of an unseen cue stick 42 is shown in notch 24 to appreciate the function of bridge 10, which will be shown in more detail below. Bridge 10 is seen in FIG. 1 and FIG. 3 resting on a playing surface 28 which is typically hard and flat and covered by a soft material such as felt. When seen in the typical manner of FIG. 1, bridge 10 resembles a miniature garden rake.

FIG. 2 is a side elevation view of the bridge 10 shown in FIG. 1. However, the bridge handle 12 has been rotated toward the viewer to bring guide plate 20 to rest on surface 28, bearing upon a short edge 30 as depicted in FIG. 4. Note that there is another opposing short edge 32 which is upwardly oriented and is elevated so a notch 34 in edge 32 may be utilized to hold and aim an unseen cue stick 42. Note also that the bridge handle 12 in FIG. 2 has been elevated above surface 28 to better bridge over an obstructing object ball 40.

In another prior art method of bridging over an obstructing ball 40 on a surface 28, FIG. 5 shows a pictorial view of an unseen player engaging a cue ball 50. A cue stick 42, having a gripping end 44 and a guiding end 46, is utilized without benefit of a bridge. The player's first hand 52 is applied near the gripping end 44 of cue stick 42 for supportively translating the cue stick 42. The player's second hand 54 is applied near the guiding end 46 to cue stick 42. Such guiding is achieved by placing hand 54 downward upon the surface 28, then raising the knuckles 55 (one shown) and the thumb 56 upwardly as shown in FIG. 5. There is formed a "V" shaped bridge 57 between the thumb 56 and the adjacent knuckle 55, and the fingers 58 and 59 (or more) bear on surface 28 to support "V" shaped bridge 57 for supportively guiding cue stick 42 over obstructing object balls 40 and 41 and into engagement with cue ball 50. A problem with the prior art method shown in FIG. 5 is that the cue ball may not always be within easy reach of the players hands 52 and 54 and the cue stick 42. Another problem is that one or more obstructing balls may be much closer than the object balls 40 and 41 are to cue ball 50. These and other problems are addressed in FIGS. 6 and 7 and are believed more fully resolved utilizing the present invention as shown in FIG. 8.

FIG. 6 shows a typical method using the bridge 10 to extend the reach of the players' hands 52 and 54. The guide plate 20 is rested in its most stable position on its long edge 17, and the opposite long edge 22, having a notch 24, is utilized to hold and guide cue stick 42. The player's hand 52 typically continues to grip end 44 and translate cue stick 42, but hand 54 is now used to grip end 14 of handle 12 and to manipulate as desired said bridge handle 12 to bring plate 20 into position behind the cue ball 50 and to hold and stabilize bridge 10 during the play.

FIG. 7 shows a typical use of the bridge 12 to reach the cue ball 50 when it is obstructed by an object ball 40. The guide plate 20 is pivoted upwardly by the player's hand 54 as indicated by the arrows R2—R2 until the guide plate 20 rests on its short edge 30, and the opposite, upward short edge 32 and its notch 34 can be utilized to hold and guide the cue stick 42. Notch 34 is about twice as high above playing surface 28 as is notch 24 shown in FIG. 6. Accordingly, the end 46 of cue stick 42 may easily be bridged over the obstructing ball to engage the cue ball 50. However, it will be appreciated that the bridge 10 is not nearly as stable in FIG. 7 as it is in FIG. 6. Moreover, the player's aim is known to be less effective and control of the translating function of hand 52 is less precise in playing a cue ball 50 with bridge 10 in the manner shown in FIG. 7. Moreover, the bridging function is less adequate when there are more than just one obstructing ball 40 as shown in FIG. 8.

FIG. 8 shows my new and improved apparatus for bridging a cue stick 42 over what may be several obstructions, such as object balls 51, 52 and 53 shown on surface 28, to engage a cue ball 50. Bridge 10 is elevated and stabilized by a bridge support 60 having a body 62 and legs 71 and 73. Only leg 73 can be seen in FIG. 8, and its further detail will be explained later below.

FIG. 8 shows that bridge support 60 is attached near end 16 of handle 12 of bridge 10. However, bridge support 60 is slidably attached to handle 12 so holder 60 may be moved according to arrow D—D to an advantageous position such as that shown in FIG. 8 when guide plate 20 is disposed between obstructing balls 51 and 52. A player's hand 54 grips end 14 of bridge handle 12 and slides bridge 10 forward or back to suit the conditions on surface 28. The end 14 of handle 12 may also be raised and lowered using holder 60 as a fulcrum according to arrow A—A to move guide plate 20 up or down according to arrow B—B to avoid an obstruction such as ball 52. Note that, with holder 60, there is no need to rotate guide plate 20 as shown in FIG. 7, so the instability associated with using the short edges 30 and 32 of guide plate 20 is avoided.

Figure 10:
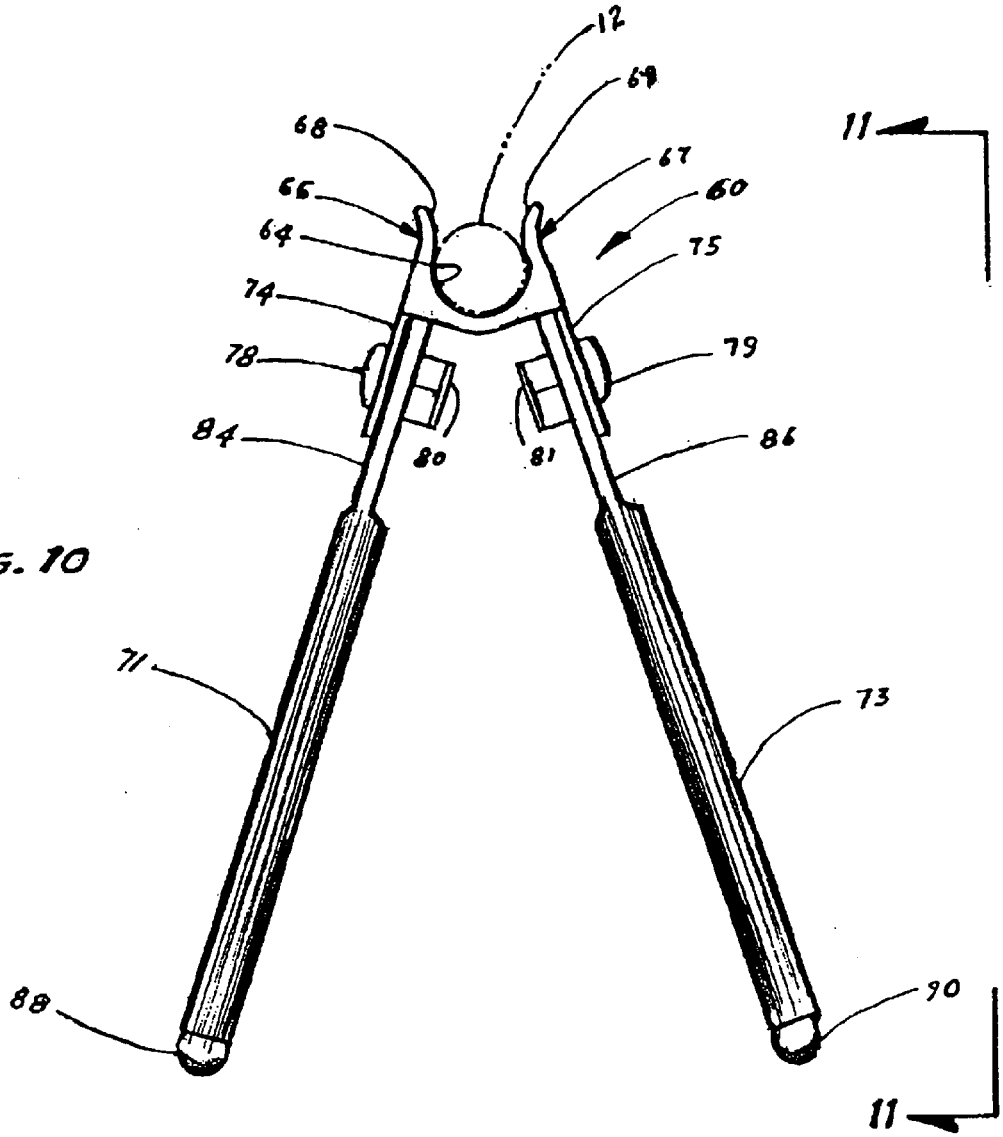
FIG. 10 is a front elevation view of the bridge support shown in FIG. 9, taken along line 10—10 in FIG. 9.
Figure 11:
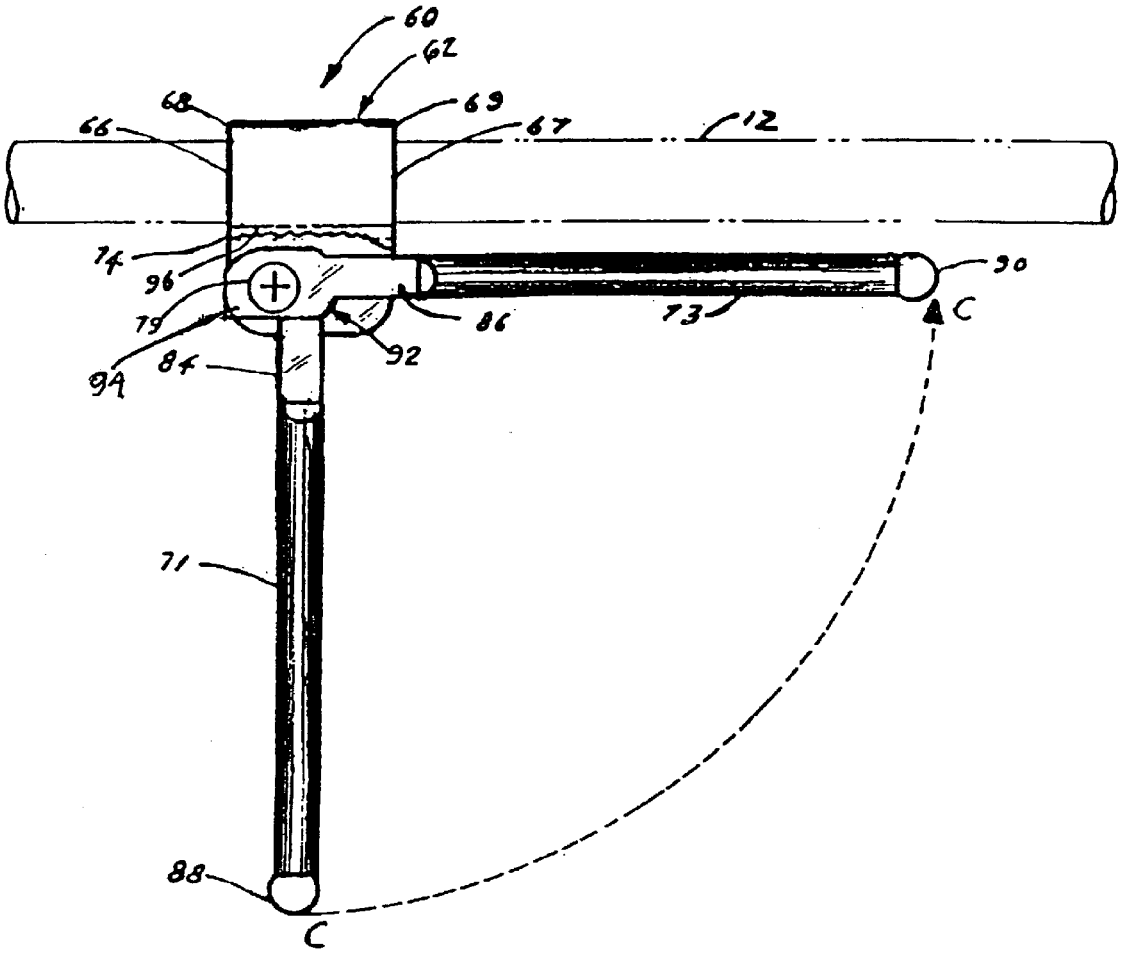
FIG. 11 is a side elevation view of the bridge support shown in FIG. 10, taken along line 11—11 in FIG. 10 and showing pivoting of the support legs.

Reference is now made to FIGS. 9, 10 and 11 which are respective top, front, and side views of bridge support 60. FIG. 9 shows that support 60 may hold and support an unseen bridge by its handle 12, shown only partially and in phantom lines in FIGS. 9, 10 and 11. Support 60 includes a body member 62 having an upwardly concaved top trough 64 and opposing sidewalls 66 and 67 which fit closely more than half way around the circumference of handle 12, as seen in FIG. 10. The trough 64 and its sidewalls 66 and 67 are of a length (about 1" as shown) along handle 12 sufficient to provide stability for holding the load of bridge 10 and cue stick 42 (neither shown).

In a presently preferred embodiment, the body member 62, its trough 64 and sidewalls 66 and 67 are made of a material such as a resilient plastic which is pliable. Sidewalls 66 and 67 are curved inwardly toward each other and have portions 68 and 69 which are curved outwardly. The portions 68 and 69 (FIG. 10) are far enough apart to readily guide handle 12 toward trough 64, and sidewalls 66 and 67 are biased toward one another so they are forced apart by handle 12 to form a snap-fit on handle 12 when handle 12 is placed in the trough 64. The snap-fit may be sufficiently tight that the entire bridge support 60 remains attached to bridge handle 12 and is not detached when bridge 10 is carried about for play or stored in a conventional stick rack.

FIG. 10 is a front view of bridge support 60 shown in FIG. 9 and is taken along line 10—10 of FIG. 9. The sidewalls 66 and 67 extend downwardly from trough 64 to form opposing skirts 74 and 75 which are preferably coextensive in length with the trough 64 to support the load of at least portions of bridge 10 and cue stick 42. The skirts 74 and 75 also contain means such as thru-bores (not shown) to make connection to the legs 71 and 73, utilizing bolts 78 and 79 and nuts 80 and 81. The legs 71 and 73 may be at least partially rounded as shown at the bottom ends 88 and 89 for protecting an unseen covered surface from damage when bridge support 60 is slid over such surface.

The connecting means for the tops of legs 71 and 73 may include flattened portions 84 and 86 as shown in FIG. 10. Such portions 84 and 86 extend sufficiently upward along and in contact with the inward surfaces of the skirts 74 and 75 such that the bolts 78 and 79 and nuts 80 and 81 can firmly connect the legs 71 and 73 for stability and reliability.

FIG. 11 is a side view of bridge support 60 taken along line 11—11 in FIG. 10. The skirt of near sidewall 67 has been broken away to show means for controlling the pivoting of leg 73. The tops of the top plates 84 and 86 have cams 92 having a wide portion 94. Accordingly, if leg 73 is pivoted in a clockwise direction, the wider portion 94 will bear on a bottom portion 96 of the body 60 and prevent pivoting in that direction. However, when leg 73 is pivoted in a counterclockwise direction as shown by arrow C—C, the wider portion 94 is pivoted away from body portion 96 and the desired pivoting is achieved, bringing leg 73 to the position shown, substantially parallel to the bridge handle 12. It will be appreciated that both legs 71 and 73 may be pivoted as described and the bridge support 60 may remain on the bridge handle 12 when support 60 is not being utilized for bridging. In a further embodiment, the bolts 78 and 79 may contain resilient means such as pliable washers or pliable material in nut bores (not shown) such that the nuts 80 and 81 hold tight when legs 71 and 73 are rotated. In a still further embodiment, the skirts 74 and 75 and the legs 71 and 73 are formed into an inverted "V" shape (FIG. 10) for stability and to distribute the load on the support 60 substantially equally between legs 71 and 73. It will be further appreciated that the legs 71 and 73 may be made longer or shorter to suit a player's desire for height above a surface 28 for engaging a cue ball 40.

There have been illustrated herein certain embodiments of the invention and certain applications of the embodiments. Nevertheless, it is to be understood that various modifications and refinements may be made and utilized which differ from these disclosed embodiments without departing from the spirit and scope of the present invention.

For example, in another embodiment, caps of a material which develop friction with the playing surface 28 may be applied over the bottom ends 88 and 89 of the legs 71 and 73. The material may be elastic to provide a tight fit over the ends may be advantageously frictional with the surface 28 to prevent movement of legs 7 and 71 during play of the game.

What is claimed is:

1. A portable bridge support snapped onto a cue stick portable bridge for supporting the cue stick portable bridge, the portable bridge having a longitudinally extending handle and a guide plate adapted to support and guide a cue stick, said portable bridge support comprising:

a body member including first and second sidewalls connected together to form a substantially U-shaped trough having flared upper ends for receiving the cue stick bridge handle which can be inserted into the body member through an opening between the flared upper ends of the U-shaped trough; and first and second legs secured to said first and second sidewalls, respectively, said legs adapted to rest on a playing surface and to hold said body member in a position to support the bridge in a desired relationship with the playing surface, wherein said sidewalls are formed of a resilient material and are responsive to being forced apart by the cue stick bridge handle to provide a snap fit of the cue stick bridge handle, securely retaining said bridge support on the bridge handle.

2. A bridge support as claimed in claim 1, wherein said legs are pivotally secured to said first and second sidewalls, respectively, permitting said legs to be pivoted in planes substantially parallel with the longitudinal axis of the bridge handle when the bridge handle is received in said trough.

3. A bridge support as claimed in claim 2, wherein each leg includes a cam portion for preventing said leg from pivoting in a first direction, while permitting the leg to pivot in a second direction, opposite the first direction.

4. A bridge support as claimed in claim 1, wherein said sidewalls are curved to form a concave trough.

5. A bridge support as claimed in claim 1, wherein each sidewall includes a skirt portion, and wherein said legs are pivotally attached to said skirt portions.

6. A bridge support as claimed in claim 5, wherein each leg includes a cam portion for preventing said leg from pivoting in a first direction, while permitting the leg to pivot in a second direction, opposite the first direction.

7. A bridge support as claimed in claim 1, wherein each leg includes bottom ends permitting said bridge support to be slid along the playing surface without damage to the playing surface.

8. A bridge support as claimed in claim 1, wherein said legs extend at an angle from said body member.

* * * * *